US012402682B1

(12) United States Patent
Leclair

(10) Patent No.: US 12,402,682 B1
(45) Date of Patent: Sep. 2, 2025

(54) REMOVABLE VISOR DEVICE

(71) Applicant: Mark Leclair, L' Ange Gardien (CA)

(72) Inventor: Mark Leclair, L' Ange Gardien (CA)

( * ) Notice: Subject to any disclaimer, the term of this patent is extended or adjusted under 35 U.S.C. 154(b) by 0 days.

(21) Appl. No.: 18/653,580

(22) Filed: May 2, 2024

(51) Int. Cl.
*A42B 3/22* (2006.01)

(52) U.S. Cl.
CPC ..... *A42B 3/226* (2013.01); *A42B 3/222* (2013.01)

(58) Field of Classification Search
CPC ..... A42B 3/22; A42B 3/221; A42B 3/222; A42B 3/223; A42B 3/224; A42B 3/225; A42B 3/226
See application file for complete search history.

(56) References Cited

U.S. PATENT DOCUMENTS

| | | | | |
|---|---|---|---|---|
| 4,047,249 | A * | 9/1977 | Booth | A42B 3/226 2/10 |
| 5,461,731 | A * | 10/1995 | Shida | A42B 3/222 2/424 |
| 5,647,066 | A | 7/1997 | Joslin | |
| 5,671,483 | A | 9/1997 | Reuber | |
| 5,991,930 | A | 11/1999 | Sorrentino | |
| 6,006,366 | A * | 12/1999 | Vondrak | A42B 3/226 2/10 |
| 9,295,297 | B2 | 3/2016 | Wilson | |
| D939,151 | S | 12/2021 | Bologna | |
| 2002/0178488 | A1 | 12/2002 | Harris | |
| 2009/0293165 | A1 * | 12/2009 | Arnold | A42B 3/226 2/15 |

FOREIGN PATENT DOCUMENTS

| | | | | |
|---|---|---|---|---|
| KR | 950000220 | * | 12/1992 | A42B 3/226 |
| WO | WO9856269 | | 12/1998 | |

* cited by examiner

*Primary Examiner* — Khoa D Huynh
*Assistant Examiner* — Erick I Lopez

(57) ABSTRACT

A removable visor device for shielding the eyes of a user from the sun while the user is wearing a helmet includes a helmet shell having a peripheral wall with an exterior surface. The helmet shell has a rounded shape wherein the helmet shell is positionable on a head of a user. The helmet shell further includes a cutout extending through the peripheral wall. The cutout exposes a face of the user when the helmet shell is positioned on the head of the user. A face shield is pivotably coupled to the peripheral wall wherein the face shield is selectively positionable over the cutout. A visor is removably couplable to the helmet shell. The visor is positionable over the exterior surface of the face shield. The visor is tinted wherein the visor is designed to inhibit light transmittance through the face shield.

13 Claims, 5 Drawing Sheets

REMOVABLE VISOR DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to protective headgear and more particularly pertains to a new protective headgear for shielding the eyes of a user from the sun while the user is wearing a helmet.

(2) Description of Related Art Including Information Disclosed Under 37 CFR 1.97 and 1.98

The prior art relates to protective headgear. For example, the prior art discloses helmets that can be worn by a user while the user is riding a motorcycle, a four wheeler, a snowmobile, or another similar vehicle. Such helmets may include visors to protect the face of the user from wind and debris. However, those visors offer limited protection against the sun for the eyes of the user. For example, these vehicles are typically driven and ridden on sunny days. The glare from the sun can make it difficult for the user to see where they are going and can even cause headaches and other discomforts. The prior art has disclosed tinted visors that can be attached to the helmet to reduce glare. However, once the sun starts to set, those tinted visors reduce visibility for the user. Some users wear sunglasses inside of their helmets. However, the heat from the face of the user often causes the sunglasses to fog, reducing visibility for the user. Thus, there is a need for a sun shielding device that can be removably attached to a helmet. Ideally, such a device would be positionable on the exterior of the helmet to inhibit fogging and facilitate visibility for the user.

BRIEF SUMMARY OF THE INVENTION

An embodiment of the disclosure meets the needs presented above by generally comprising a helmet shell including a peripheral wall having an exterior surface. The helmet shell has a rounded shape wherein the helmet shell is configured to be positionable on a head of a user. The helmet shell further includes a cutout extending through the peripheral wall wherein the cutout is configured to expose a face of the user when the helmet shell is positioned on the head of the user. A face shield is pivotably coupled to the peripheral wall wherein the face shield is selectively positionable over the cutout. A visor is removably couplable to the helmet shell. The visor is positionable over the exterior surface of the face shield. The visor is tinted wherein the visor is configured to inhibit light transmittance through the face shield.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
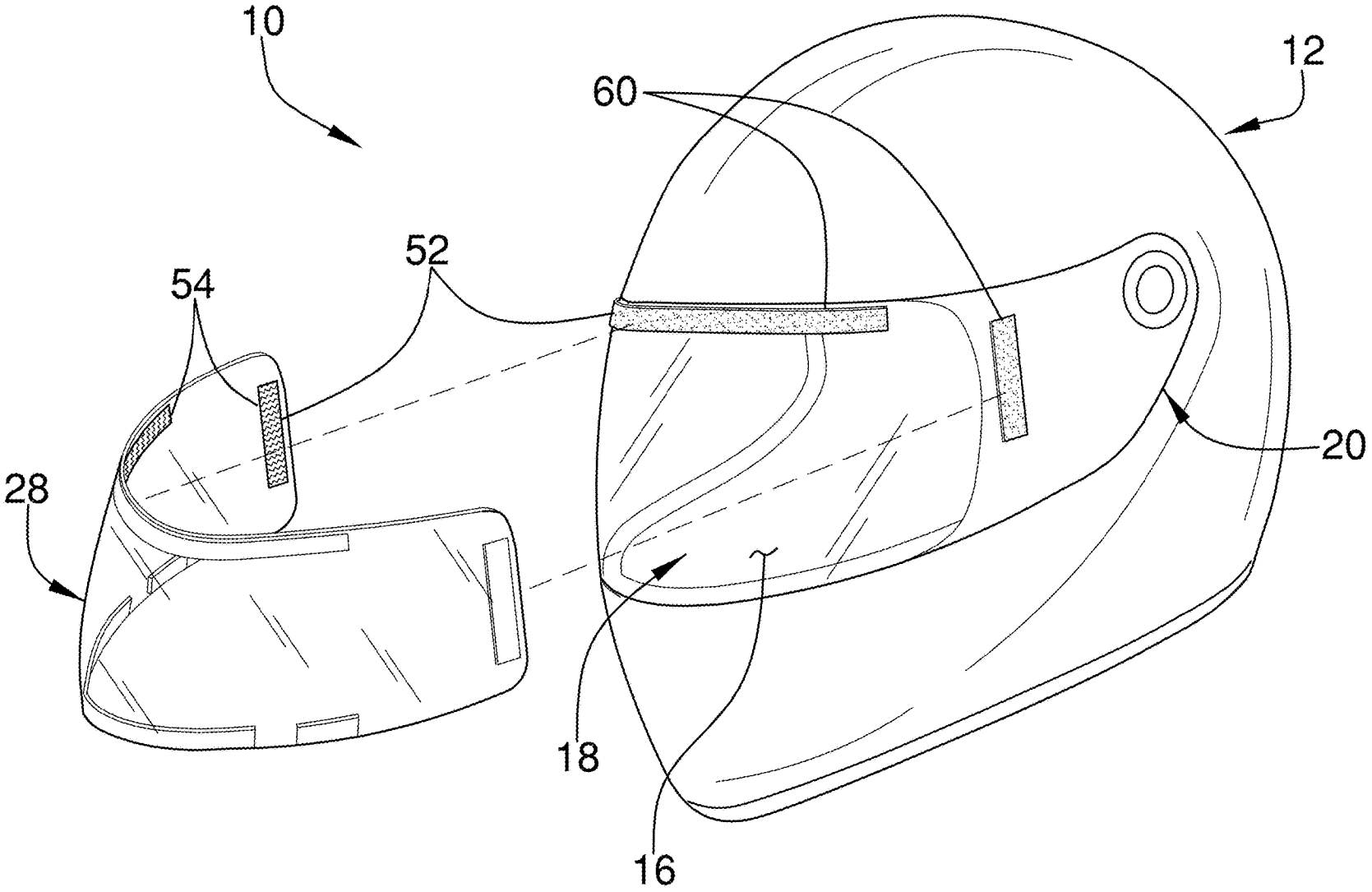
FIG. 1 is an exploded isometric view of a removable visor device according to an embodiment of the disclosure.

With reference now to the drawings, and in particular to FIGS. 1 through 6 thereof, a new protective headgear embodying the principles and concepts of an embodiment of the disclosure and generally designated by the reference numeral 10 will be described.

As best illustrated in FIGS. 1 through 6, the removable visor device 10 generally comprises a helmet shell 12 including a peripheral wall 14 having an exterior surface 16. The helmet shell 12 generally has a rounded shape wherein the helmet shell 12 is configured to be positionable on a head of a user. A cutout 18 extends through the peripheral wall 14. The cutout 18 is designed to expose a face of the user when the helmet shell 12 is positioned on the head of the user.

A face shield 20 is coupled to the peripheral wall 14. The face shield 20 is positioned on the exterior surface 16 of the peripheral wall 14. The face shield 20 may be pivotably coupled to the peripheral wall 14 wherein the face shield 20 is selectively positionable over the cutout 18. The face shield 20 is generally transparent wherein the face shield 20 is configured to facilitate the user in looking through the face shield 20 when the helmet shell 12 is positioned on the head of the user. The face shield 20 may include a face shield upper edge 22 and a face shield lower edge 24. A pair of face shield opposing lateral ends 26 is generally coupled to and extends between the face shield upper edge 22 and the face shield lower edge 24.

A visor 28 is removably couplable to the helmet shell 12. The visor 28 is positionable over the exterior surface 16 of the face shield 20. The visor 28 is configured to be inhibited from fogging up when the visor 28 is positioned on the face shield 20. For example, heat from the user may fog glasses or goggles that are within the helmet shell 12, or that are positioned on an interior surface of the face shield 20. However, the face shield 20 inhibits the heat from fogging the visor 28 on the exterior surface 16 of the face shield 20. The visor 28 is generally tinted wherein the visor 28 is configured to inhibit light transmittance through the face shield 20. For example, the visor 28 may be tinted to reduce glare from the sun for the user when the user is looking through the face shield 20 during a sunny day.

The visor 28 may be curved wherein the visor 28 is configured to complement a curvature of the face shield 20. The visor 28 may also comprise a resiliently deformable material wherein the visor 28 is configured to conform to the curvature of the face shield 20 when the visor 28 is coupled to the face shield 20. The resiliently deformable material may comprise plastic, or another flexible material that can bend to conform to the curvature of the face shield 20 without breaking or cracking.

Figure 5:
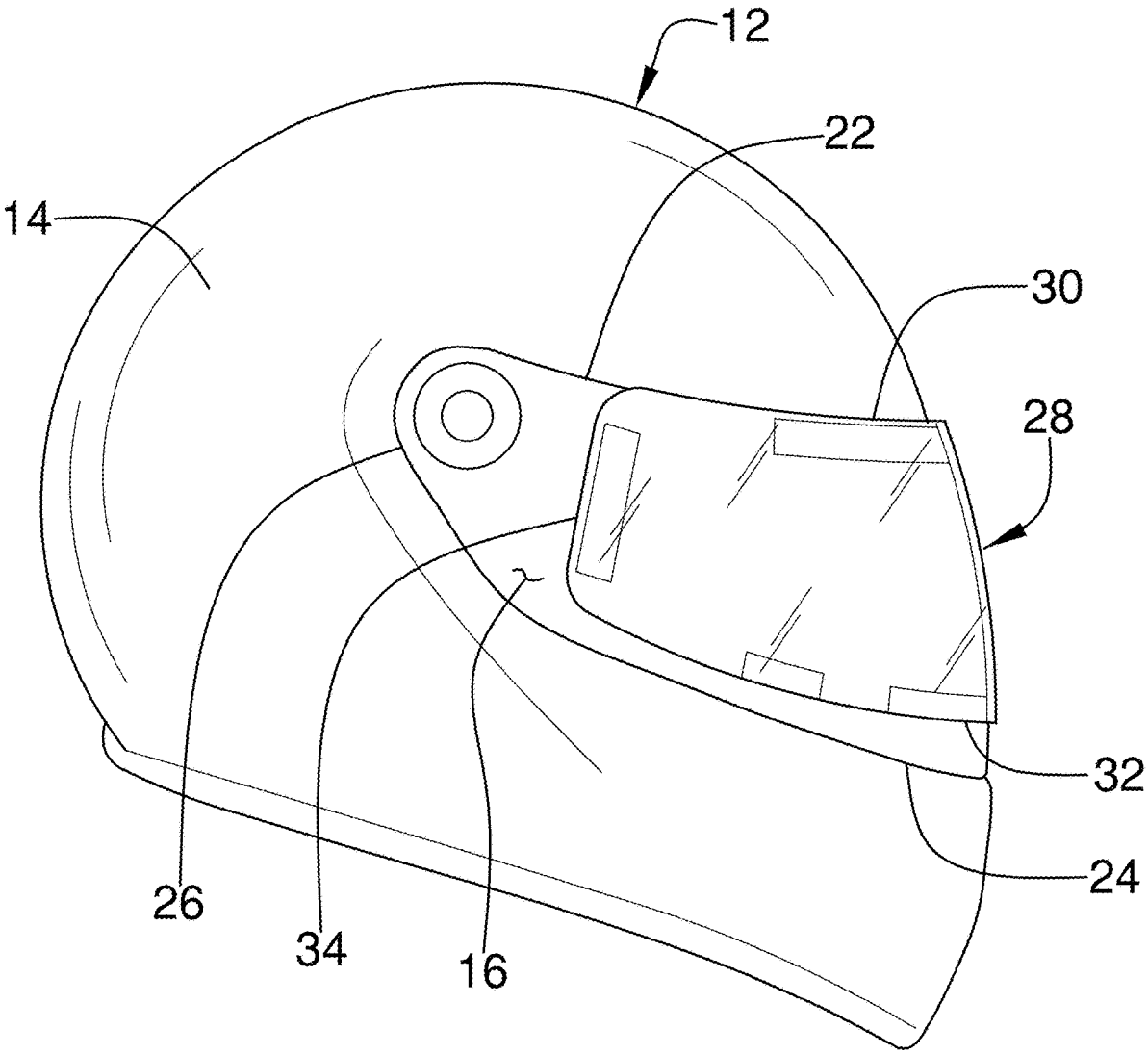
FIG. 5 is a side view of an embodiment of the disclosure.
Figure 6:
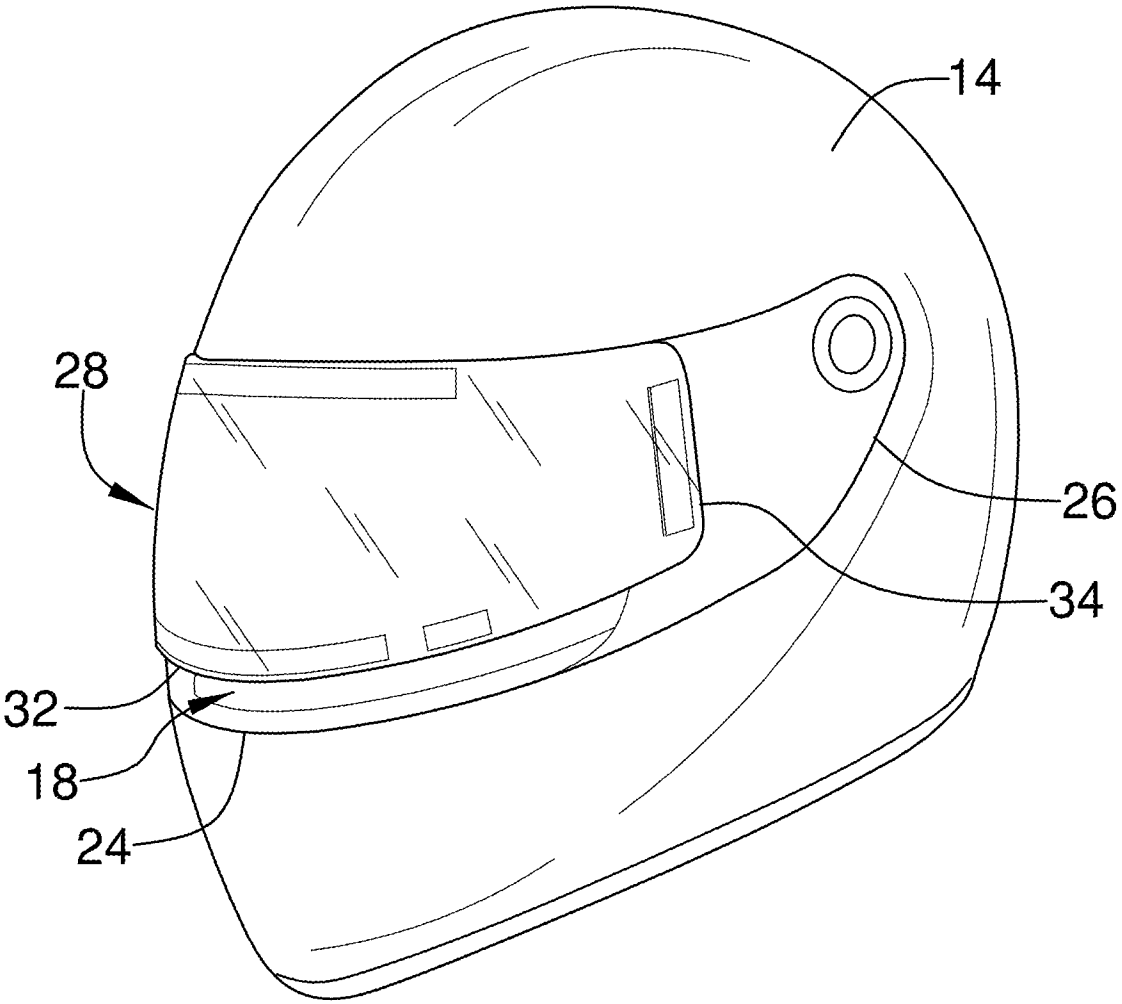
FIG. 6 is a perspective view of an embodiment of the disclosure.

The visor 28 may include a visor top edge 30 that is alignable with the face shield upper edge 22. As shown in FIG. 5, the visor top edge 30 may cover at least part of the face shield upper edge 22 when the visor 28 is coupled to the face shield 20. The visor top edge 30 may be parallel to the face shield upper edge 22 when the visor 28 is coupled to the face shield 20. The visor 28 generally has a visor front side 36 and a visor back side 38. The visor back side 38 is positionable against the exterior surface 16 of the face shield 20.

A visor bottom edge 32 is positionable proximate to the face shield lower edge 24. The visor 28 may have a visor height that is less than a face shield height of the face shield 20 wherein visor bottom edge 32 is positionable above the face shield lower edge 24. Because the visor 28 is configured to cover a pair of eyes of the user when the visor 28 is coupled to the face shield 20, thereby shielding the pair of eyes from the sun, the visor 28 may only partially covers the face shield 20 when the visor 28 is coupled to the face shield 20. An exemplary embodiment of the visor height compared to the face shield height is provided in FIG. 5. In other embodiments, the visor height may be equal to the face shield height, wherein the visor completely covers the face shield 20 and wherein the visor bottom edge 32 covers at least part of the face shield lower edge 24. The visor bottom edge 32 is generally parallel to the face shield lower edge 24 when the visor 28 is coupled to the face shield 20.

A pair of visor opposing lateral ends 34 may be coupled to and extend between the visor top edge 30 and the visor bottom edge 32. The pair of visor opposing lateral ends 34 is positionable proximate to the pair of face shield opposing lateral ends 26. The visor 28 may have a visor width 48 that is less than a face shield width of the face shield 20 wherein each visor opposing lateral end of the pair of visor opposing lateral ends 34 is spaced from a respective face shield opposing lateral end of the pair of face shield opposing lateral ends 26 when the visor 28 is coupled to the face shield 20.

A visor centerline height 40 between a visor top edge center point 42 and a visor bottom edge center point 44 may be between 1.75 inches and 4.75 inches. The visor top edge center point 42 is positioned on the visor top edge 30 and is equidistantly positioned between the pair of visor opposing lateral ends 34. Similarly, the visor bottom edge center point 44 is positioned on the visor bottom edge 32 and is equidistantly positioned between the pair of visor opposing lateral ends 34. The visor top edge center point 42 is generally aligned with the visor bottom edge center point 44 across the visor 28. The visor centerline height 40 may be measured perpendicularly to the visor top edge 30 and the visor bottom edge 32.

Each of the visor top edge 30 and the visor bottom edge 32 may be angled inwardly toward each other and outwardly toward the pair of visor opposing lateral ends 34. In such embodiments, the visor centerline height 40 generally exceeds a visor opposing lateral end height 46. The visor opposing lateral end height 46 is measured between the visor top edge 30 and the visor bottom edge 32 adjacent to each visor opposing lateral end of the pair of visor opposing lateral ends 34. The visor opposing lateral end height 46 may be between 1.5 inches and 3.5 inches. For example, the visor centerline height 40 may be approximately 3.25 inches while the visor opposing lateral end height 46 may be approximately 2.5 inches. The visor opposing lateral end height 46 may be measured perpendicularly to the visor top edge 30 and the visor bottom edge 32.

A visor width 48 between the pair of visor opposing lateral ends 34 when the visor 28 is in a planar position may be between 8.5 inches and 10.5 inches. When the visor 28 is bent to conform to the curvature of the face shield 20, the pair of visor opposing lateral ends 34 may be positioned more closely together, reducing the visor width 48. The visor width 48 may be measured perpendicularly to the pair of visor opposing lateral ends 34.

A visor thickness 50 between the visor front side 36 and the visor back side 38 may be between 0.1 inches and 0.2 inches. The visor thickness 50 may be measured perpendicularly to the visor front side 36 and the visor back side 38.

A coupler 52 may removably couple the visor 28 to the face shield 20. For example, the coupler 52 may include a first mating member 54 that is attached to the visor back side 38 and a second mating member 60 that is attached to the exterior surface 16 of the face shield 20. The second mating member 60 is releasably engageable with the first mating member 54. The second mating member 60 is alignable with the first mating member 54 when the visor 28 is coupled to the face shield 20. Each of the first mating member 54 and the second mating member 60 may comprise a hook and loop material, although other materials, such as magnets and snaps are also contemplated.

The first mating member 54 may include a first mating member central piece 56 that is generally centrally positioned on the visor top edge 30. For example, the first mating member central piece 56 may be centered over the visor top edge center point 42. The first mating member central piece 56 may be parallel to the visor top edge 30. The first mating member central piece 56 may be elongated. For example, the first mating member central piece 56 may be rectangular.

A pair of first mating member lateral pieces 58 may be spaced from the first mating member central piece 56. For example, each first mating member lateral piece of the pair of first mating member lateral pieces 58 may be positioned proximate to a respective visor opposing lateral end of the pair of visor opposing lateral ends 34. Each first mating member lateral piece of the pair of first mating member lateral pieces 58 may be perpendicular to the first mating member central piece 56.

The second mating member 60 may include a second mating member central piece 62 that is generally centrally positioned along the face shield upper edge 22. The second mating member central piece 62 may have a size that is equal to a size of the first mating member central piece 56. The second mating member central piece 62 may be parallel to the face shield upper edge 22.

A pair of second mating member lateral pieces 64 may be spaced from the second mating member central piece 62. For example, each second mating member 60 lateral piece of the pair of second mating member lateral pieces 64 may be positioned proximate to a respective face shield opposing lateral end of the pair of face shield opposing lateral ends 26. The pair of second mating member lateral pieces 64 may be positioned over the peripheral wall 14 of the helmet shell 12 when the face shield 20 is pivoted downwardly to cover the cutout 18 wherein the pair of second mating member lateral pieces 64 are configured to be inhibited from view of the user when the user is wearing the helmet shell 12. Each of the pair of second mating member lateral pieces 64 generally has a size that is equal to a size of a respective first mating member lateral piece of the pair of first mating member lateral pieces 58. The pair of second mating member lateral pieces 64 may be perpendicular to the second mating member central piece 62.

A guard 66 may be coupled to the visor 28. The guard 66 is generally positioned between the visor 28 and the face shield 20 when the visor 28 is coupled to the face shield 20 wherein the guard 66 spaces the visor 28 from the face shield 20 to inhibit the visor 28 from damaging the face shield 20. For example, the guard 66 may inhibit the visor 28 from scratching the face shield 20. The guard 66 may be spaced from the coupler 52.

The guard 66 may include a plurality of spacers 68 that is coupled to the visor back side 38 of the visor 28. The plurality of spacers 68 may be positioned along or adjacent to the visor bottom edge 32. Each spacer of the plurality of spacers 68 may comprise a rubber material, although alternative materials such as plastic and fabric are also contemplated.

A central spacer 70 may be centrally positioned along the visor bottom edge 32. For example, the central spacer 70 may be positioned over the visor bottom edge center point 44. In such embodiments, the central spacer 70 may be aligned with the first mating member central piece 56 across the visor 28. The central spacer 70 may be parallel to the visor bottom edge 32. The central spacer 70 may be elongated. For example, the central spacer 70 may be rectangular.

Figure 2:
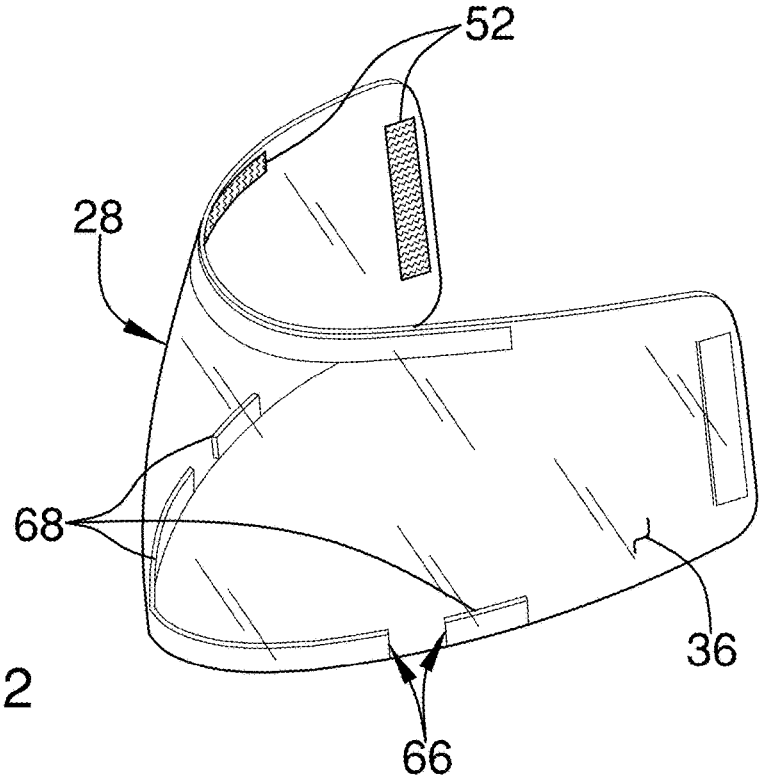
FIG. 2 is an exploded perspective view of an embodiment of the disclosure.
Figure 3:
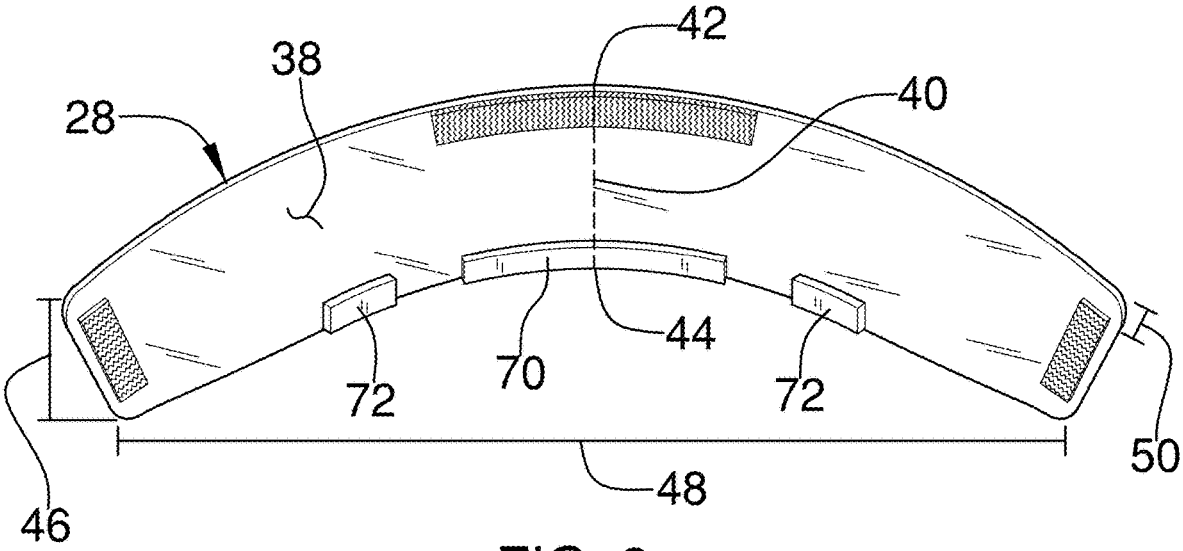
FIG. 3 is a rear isometric view of an embodiment of the disclosure.
Figure 4:
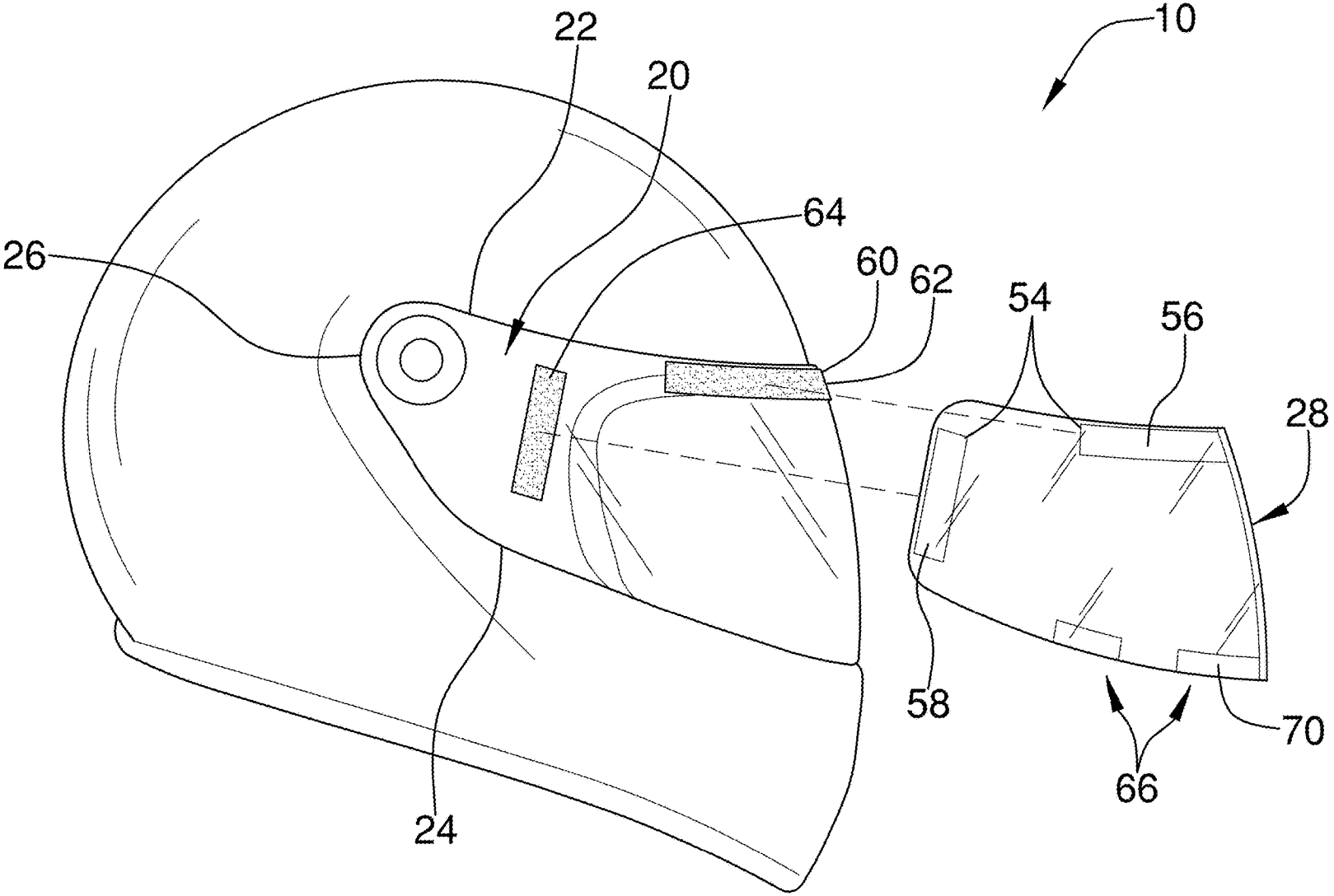
FIG. 4 is an exploded side view of an embodiment of the disclosure.

A pair of lateral spacers 72 may be positioned on opposing lateral sides of the central spacer 70. For example, the pair of lateral spacers 72 may be positioned along the visor bottom edge 32, as shown in FIG. 2. The pair of lateral spacers 72 may be parallel to the central spacer 70. Each lateral spacer of the pair of lateral spacers 72 may be spaced from the central spacer 70. Each lateral spacer of the pair of lateral spacers 72 may have a length that is less than a length of the central spacer 70. Each lateral spacer of the pair of lateral spacers 72 may have a height that is equal to a height of the central spacer 70. Each lateral spacer of the pair of lateral spacers 72 may be spaced from a respective opposing lateral end of the pair of visor opposing lateral ends 34. Each lateral spacer of the pair of lateral spacers 72 may be rectangular, although alternative shapes are also contemplated.

In use, the user can releasably attach the visor 28 to the face shield 20, for example in bright sunlight conditions. The coupler 52 facilitates the user in repeatedly coupling and decoupling the visor 28 and the face shield 20. The tint of the visor 28 will reduce light transmittance through the face shield 20 to protect the eyes of the user from the sun. Because the visor 28 is positioned on the exterior surface 16 of the face shield 20, the visor 28 will not fog up during use. The guard 66 protects the face shield 20 from being damaged by the visor 28.

The shape of the visor 28 generally complements the shape of the face shield 20. As explained above, the visor 28 may be slightly smaller than the face shield 20, wherein the visor 28 partially covers the face shield 20 when the visor 28 is coupled to the face shield 20. The visor 28 may comprise the resiliently deformable material so that the curvature of the visor 28 conforms to the curvature of the face shield 20. Accordingly, the visor 28 can be removably attached to any face shield 20 of any helmet shell 12, once the second mating member 60 is attached to the exterior surface 16 of the face shield 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sun shielding assembly comprising:

a helmet shell including a peripheral wall having an exterior surface, the helmet shell having a rounded shape wherein the helmet shell is configured to be positionable on a head of a user, the helmet shell further including:

a cutout extending through the peripheral wall wherein the cutout is configured to expose a face of the user when the helmet shell is positioned on the head of the user;

a face shield being pivotably coupled to the peripheral wall wherein the face shield is selectively positionable over the cutout;

a visor being removably couplable to the helmet shell, the visor being positionable over the exterior surface of the face shield, the visor being tinted wherein the visor is configured to inhibit light transmittance through the face shield; and a coupler removably coupling the visor to the face shield, the coupler including:

a first mating member being attached to a visor back side of the visor, the first mating member including:

a first mating member central piece being centrally positioned on a visor top edge of the visor, the first mating member central piece being parallel to the visor top edge, the first mating member central piece having a length being less than a length of the visor top edge wherein the first mating member central piece is configured to facilitate airflow upwardly and outwardly from between the face shield and the visor;

a pair of first mating member lateral pieces being spaced from the first mating member central piece, each first mating member lateral piece of the pair of first mating member lateral pieces being perpendicular to the first mating member central piece;

a second mating member being releasably engageable with the first mating member, the second mating member being attached to the exterior surface of the face shield, the second mating member being alignable with the first mating member when the visor is coupled to the face shield whereby the coupler is configured to secure the visor to the face shield along an axis being parallel to the visor top edge and along an axis being perpendicular to the visor top edge to inhibit airflow directed upwardly from detaching the visor from the face shield and to inhibit airflow directed laterally from opposing sides between the face shield and the visor from detaching the visor from the face shield.

2. The sun shielding assembly of claim 1, wherein the visor is curved, wherein the visor is configured to complement a curvature of the face shield.

3. The sun shielding assembly of claim 2, the visor further comprising a resiliently deformable material, wherein the visor is configured to conform to the curvature of the face shield when the visor is coupled to the face shield.

4. The sun shielding assembly of claim 1, wherein the visor has a visor height being less than a face shield height of the face shield wherein the visor is configured to cover a pair of eyes of the user when the visor is coupled to the face shield.

5. The sun shielding assembly of claim 1, the second mating member further comprising a second mating member central piece being positioned on a face shield upper edge of the face shield.

6. The sun shielding assembly of claim 5, the second mating member further comprising a pair of second mating member lateral pieces being spaced from the second mating member central piece.

7. The sun shielding assembly of claim 6, wherein the pair of second mating member lateral pieces is positioned over the peripheral wall of the helmet shell when the face shield is pivoted downwardly to cover the cutout wherein the pair of second mating member lateral pieces are configured to be inhibited from view of the user when the user is wearing the helmet shell.

8. The sun shielding assembly of claim 1, further comprising a guard being coupled to the visor, the guard being positioned between the visor and the face shield when the visor is coupled to the face shield wherein the guard spaces the visor from the face shield to inhibit the visor from damaging the face shield.

9. The sun shielding assembly of claim 8, the guard further comprising a plurality of spacers being coupled to a visor back side of the visor.

10. The sun shielding assembly of claim 9, wherein the plurality of spacers is positioned adjacent to a visor bottom edge of the visor.

11. The sun shielding assembly of claim 9, the plurality of spacers further comprising a central spacer being positioned along a visor bottom edge of the visor.

12. The sun shielding assembly of claim 11, the plurality of spacers further comprising a pair of lateral spacers being positioned on opposing lateral sides of the central spacer.

13. A sun shielding assembly comprising:

a helmet shell including a peripheral wall having an exterior surface, the helmet shell having a rounded shape wherein the helmet shell is configured to be positionable on a head of a user, the helmet shell further including:

a cutout extending through the peripheral wall wherein the cutout is configured to expose a face of the user when the helmet shell is positioned on the head of the user;

a face shield being coupled to the peripheral wall, the face shield being positioned on the exterior surface of the peripheral wall, the face shield being pivotably coupled to the peripheral wall wherein the face shield is selectively positionable over the cutout, the face shield being transparent wherein the face shield is configured to facilitate the user in looking through the face shield when the helmet shell is positioned on the head of the user, the face shield including:

a face shield upper edge;

a face shield lower edge;

a pair of face shield opposing lateral ends being coupled to and extending between the face shield upper edge and the face shield lower edge;

a visor being removably couplable to the helmet shell, the visor being positionable over the exterior surface of the face shield, the visor being tinted wherein the visor is configured to inhibit light transmittance through the face shield, the visor being curved wherein the visor is configured to complement a curvature of the face shield, the visor comprising a resiliently deformable material wherein the visor is configured to conform to the curvature of the face shield when the visor is coupled to the face shield, the resiliently deformable material comprising plastic, the visor including:

a visor top edge being alignable with the face shield upper edge, the visor top edge being parallel to the face shield upper edge when the visor is coupled to the face shield;

a visor bottom edge being positionable proximate to the face shield lower edge, the visor having a visor height being less than a face shield height of the face shield wherein visor bottom edge is positionable above the face shield lower edge and wherein the visor is configured to cover a pair of eyes of the user when the visor is coupled to the face shield, the visor bottom edge being parallel to the face shield lower edge when the visor is coupled to the face shield;

a pair of visor opposing lateral ends being coupled to and extending between the visor top edge and the visor bottom edge, the pair of visor opposing lateral ends being positionable proximate to the pair of face shield opposing lateral ends, the visor having a visor width being less than a face shield width of the face shield wherein each visor opposing lateral end of the pair of visor opposing lateral ends is spaced from a respective face shield opposing lateral end of the pair of face shield opposing lateral ends when the visor is coupled to the face shield;

a visor front side;

a visor back side being positionable against the exterior surface of the face shield;

a visor centerline height between a visor top edge center point and a visor bottom edge center point being between 1.75 inches and 4.75 inches, the visor top edge center point being positioned on the visor top edge equidistantly between the pair of visor opposing lateral ends, the visor bottom edge center point being positioned on the visor bottom edge equidistantly between the pair of visor opposing lateral ends, each of the visor top edge and the visor bottom edge being angled inwardly toward each other and outwardly toward the pair of visor opposing lateral ends wherein the visor centerline height exceeds a visor opposing lateral end height, the visor opposing lateral end height being measured between the visor top edge and the visor bottom edge adjacent to each visor opposing lateral end of the pair of visor opposing lateral ends, the visor opposing lateral end height being between 1.5 inches and 3.5 inches;

a visor width between the pair of visor opposing lateral ends when the visor is in a planar position being between 8.5 inches and 10.5 inches; and a visor thickness between the visor front side and the visor back side being between 0.1 inches and 0.2 inches;

a coupler removably coupling the visor to the face shield, the coupler including:

a first mating member being attached to the visor back side, the first mating member including:

a first mating member central piece being centrally positioned on the visor top edge, the first mating member central piece being parallel to the visor top edge, the first mating member central piece having a length being less than a length of the visor top edge wherein the first mating member central piece is configured to facilitate airflow upwardly and outwardly from between the face shield and the visor, the first mating member central piece being rectangular; and a pair of first mating member lateral pieces being spaced from the first mating member central piece, each first mating member lateral piece of the pair of first mating member lateral pieces being positioned proximate to a respective visor opposing lateral end of the pair of visor opposing lateral ends, each first mating member lateral piece of the pair of first mating member lateral pieces being perpendicular to the first mating member central piece;

a second mating member being releasably engageable with the first mating member, the second mating member being attached to the exterior surface of the face shield, the second mating member being alignable with the first mating member when the visor is coupled to the face shield whereby the coupler is configured to secure the visor to the face shield along an axis being parallel to the visor top edge and along an axis being perpendicular to the visor top edge to inhibit airflow directed upwardly from detaching the visor from the face shield and to inhibit airflow directed laterally from opposing sides between the face shield and the visor from detaching the visor from the face shield, the second mating member including:

a second mating member central piece being centrally positioned along the face shield upper edge, the second mating member central piece having a size being equal to a size of the first mating member central piece, the second mating member central piece being parallel to the face shield upper edge; and a pair of second mating member lateral pieces being spaced from the second mating member central piece, each second mating member lateral piece of the pair of second mating member lateral pieces being positioned proximate to a respective face shield opposing lateral end of the pair of face shield opposing lateral ends, each of the pair of second mating member lateral pieces having a size being equal to a size of a respective first mating member lateral piece of the pair of first mating member lateral pieces, the pair of second mating member lateral pieces being perpendicular to the second mating member central piece, the pair of second mating member lateral pieces being positioned over the peripheral wall of the helmet shell when the face shield is pivoted downwardly to cover the cutout wherein the pair of second mating member lateral pieces are configured to be inhibited from view of the user when the user is wearing the helmet shell;

wherein each of the first mating member and the second mating member comprise a hook and loop material;

a guard being coupled to the visor, the guard being positioned between the visor and the face shield when the visor is coupled to the face shield wherein the guard spaces the visor from the face shield to inhibit the visor from damaging the face shield, the guard being spaced from the coupler, the guard including:

a plurality of spacers being coupled to the visor back side of the visor, the plurality of spacers being positioned adjacent to the visor bottom edge, each spacer of the plurality of spacers comprising a rubber material, the plurality of spacers including:

a central spacer being centrally positioned along the visor bottom edge, the central spacer being parallel to the visor bottom edge, the central spacer being elongated, the central spacer being rectangular, the central spacer being aligned with the first mating member central piece across the visor; and a pair of lateral spacers being positioned on opposing lateral sides of the central spacer, the pair of lateral spacers being parallel to the central spacer, each lateral spacer of the pair of lateral spacers being spaced from the central spacer, each lateral spacer of the pair of lateral spacers having a length being less than a length of the central spacer, each lateral spacer of the pair of lateral spacers having a height being equal to a height of the central spacer, each lateral spacer of the pair of lateral spacers being spaced from a respective opposing lateral end of the pair of visor opposing lateral ends, each lateral spacer of the pair of lateral spacers being rectangular.

* * * * *